US008052121B2

(12) United States Patent
Christie

(10) Patent No.: US 8,052,121 B2
(45) Date of Patent: Nov. 8, 2011

(54) SCISSOR JACK

(75) Inventor: Colin Christie, Moreleta Park (ZA)

(73) Assignee: Quaddro Technologies (PTY) Ltd., Pretoria (ZA)

( * ) Notice: Subject to any disclaimer, the term of this patent is extended or adjusted under 35 U.S.C. 154(b) by 532 days.

(21) Appl. No.: 12/094,368

(22) PCT Filed: Nov. 27, 2006

(86) PCT No.: PCT/IB2006/054465

§ 371 (c)(1), (2), (4) Date: Oct. 23, 2008

(87) PCT Pub. No.: WO2007/096714

PCT Pub. Date: Aug. 30, 2007

(65) Prior Publication Data

US 2009/0200527 A1 Aug. 13, 2009

(30) Foreign Application Priority Data

| | | |
|---|---|---|
| Nov. 28, 2005 | (ZA) | 2005/09554 |
| Feb. 22, 2006 | (ZA) | 2006/01531 |
| Mar. 22, 2006 | (ZA) | 2006/02326 |
| Mar. 27, 2006 | (ZA) | 2006/02455 |

(51) Int. Cl.
*B66F 3/22* (2006.01)

(52) U.S. Cl. ..... 254/122; 254/124; 254/126

(58) Field of Classification Search ..... 254/122, 254/124, 126

See application file for complete search history.

(56) References Cited

U.S. PATENT DOCUMENTS 6,161,816 A 12/2000 Kikuchi
6,334,605 B1 * 1/2002 Kikuchi ..... 254/126

FOREIGN PATENT DOCUMENTS

GB 334 283 A 9/1930
GB 334283 * 9/1930

OTHER PUBLICATIONS

International Search Report for PCT/IB2006/054465, date of mailing Oct. 24, 2007.

* cited by examiner

*Primary Examiner* — Joseph J Hail
*Assistant Examiner* — Shantese McDonald
(74) *Attorney, Agent, or Firm* — Hamilton, Brook, Smith & Reynolds, P.C.

(57) ABSTRACT

The invention involves a scissor jack having four arms hingedly arranged to provide two opposite elbows between a base and a load support. A pair of trunnions at the elbows is connected by a threaded shaft. A movable brace is supported between the arms. The brace strengthens and adds support to the jack assembly. In a preferred embodiment, the brace includes a guide assembly which slidably engages the shaft and connectors pivoted between the guide and each of the four arms. The connectors are extensible socket and rod arrangements. Each connector includes a coil spring located over the rod in the socket. The four springs are compressed on extension of the jack to assist in lifting a load.

4 Claims, 3 Drawing Sheets

SCISSOR JACK

RELATED APPLICATIONS

This application is the U.S. National Stage of International Application No. PCT/IB2006/054465, filed Nov. 27, 2006, published in English, and claims priority under 35 U.S.C. §119 or 365 to South African Application No. 2005/09554, filed Nov. 28, 2005, South African Application No. 2006/01531, filed Feb. 22, 2006, South African Application No. 2006/02326, filed Mar. 22, 2006, and South African Application No. 2006/02455, filed Mar. 27, 2006.

FIELD OF THE INVENTION

This invention relates to structural improvements to a scissor jack.

BACKGROUND TO THE INVENTION

Scissor jacks are well known and most commonly used for lifting vehicles. This type of jack is also sometimes referred to as a screw-operated jack. The basic design and principle of operation has been used for some time.

Improvements to these jacks have generally related to the screw-threaded shaft or to the trunnions which connect the shaft into the assembly. A relatively large amount of force is required to lift a load with these jacks or, alternatively, the lifting rate is made slower so that less force is required.

Where jacks are used in off-road conditions they are often subjected to more severe mechanical stresses. These can increase the chance of component structural failure.

The problems with inefficient lifting and mechanical failure are emphasized where heavier vehicles need to be lifted. In addition to some of the larger four wheel drive vehicles on the market, the military also generally use heavier vehicles.

OBJECT OF THE INVENTION

It is an object of the current invention to provide a scissor jack that will at least partially mitigate the mentioned problems.

SUMMARY OF THE INVENTION

In accordance with this invention there is provided a scissor jack comprising four arms hingedly arranged to provide two opposite elbows between a base and a load support, with a pair of trunnions at the elbows connected by a threaded shaft, and having a movable brace supported between the arms.

The invention further provides for the brace to include a guide which slidably engages the shaft and connectors pivoted between the guide and each of the four arms.

Further features of the invention provide for the connectors to be extensible; for each connector to include a spring which is compressed on extension of the jack; and for each connector to be a socket and rod arrangement with a coil spring located over the rod in the socket.

BRIEF DESCRIPTION OF THE DRAWINGS

These and other features of the invention will now be described, by way of example only, with reference to the accompanying drawings in which.

DETAILED DESCRIPTION OF THE DRAWINGS

Figure 1:
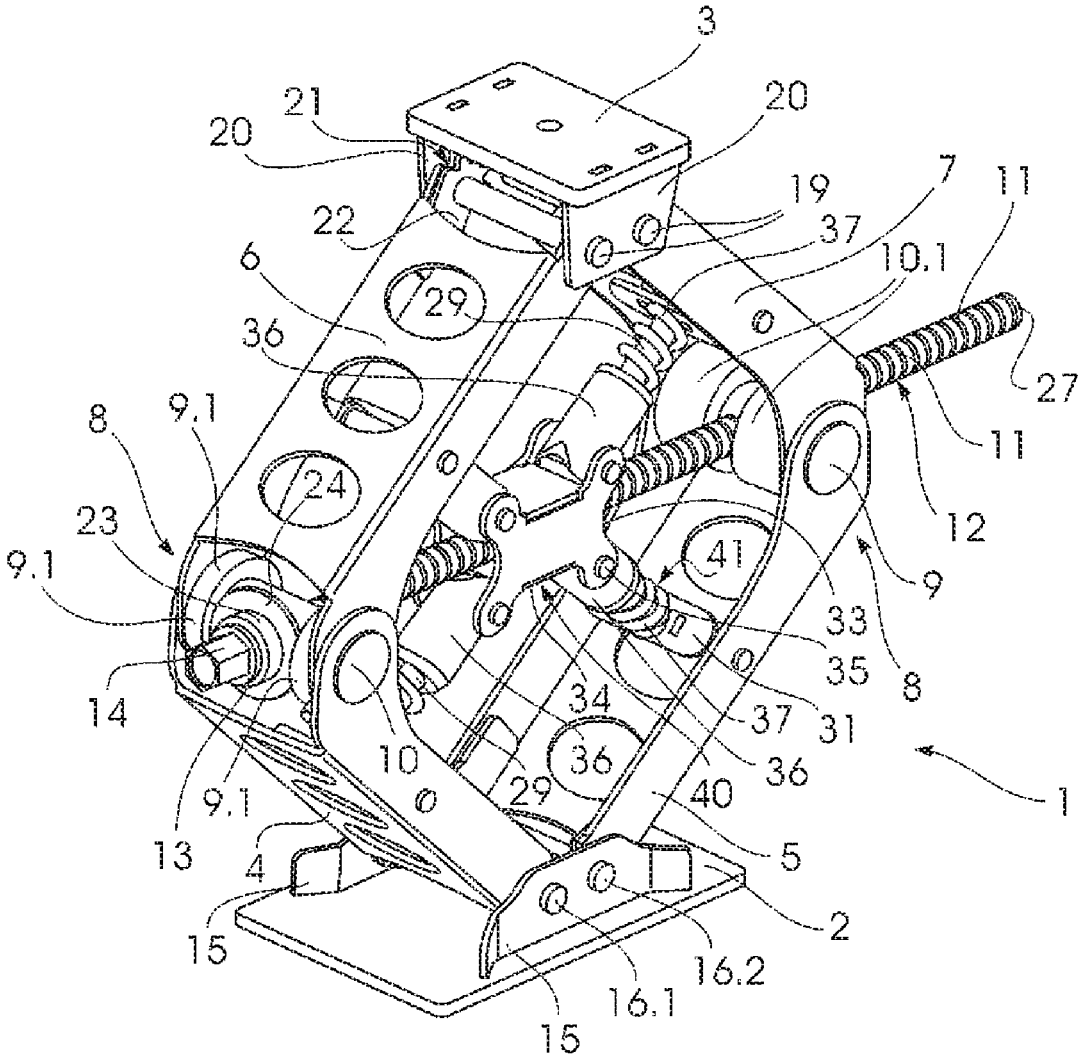
FIG. 1 shows a first perspective view of a scissor jack.
Figure 2:
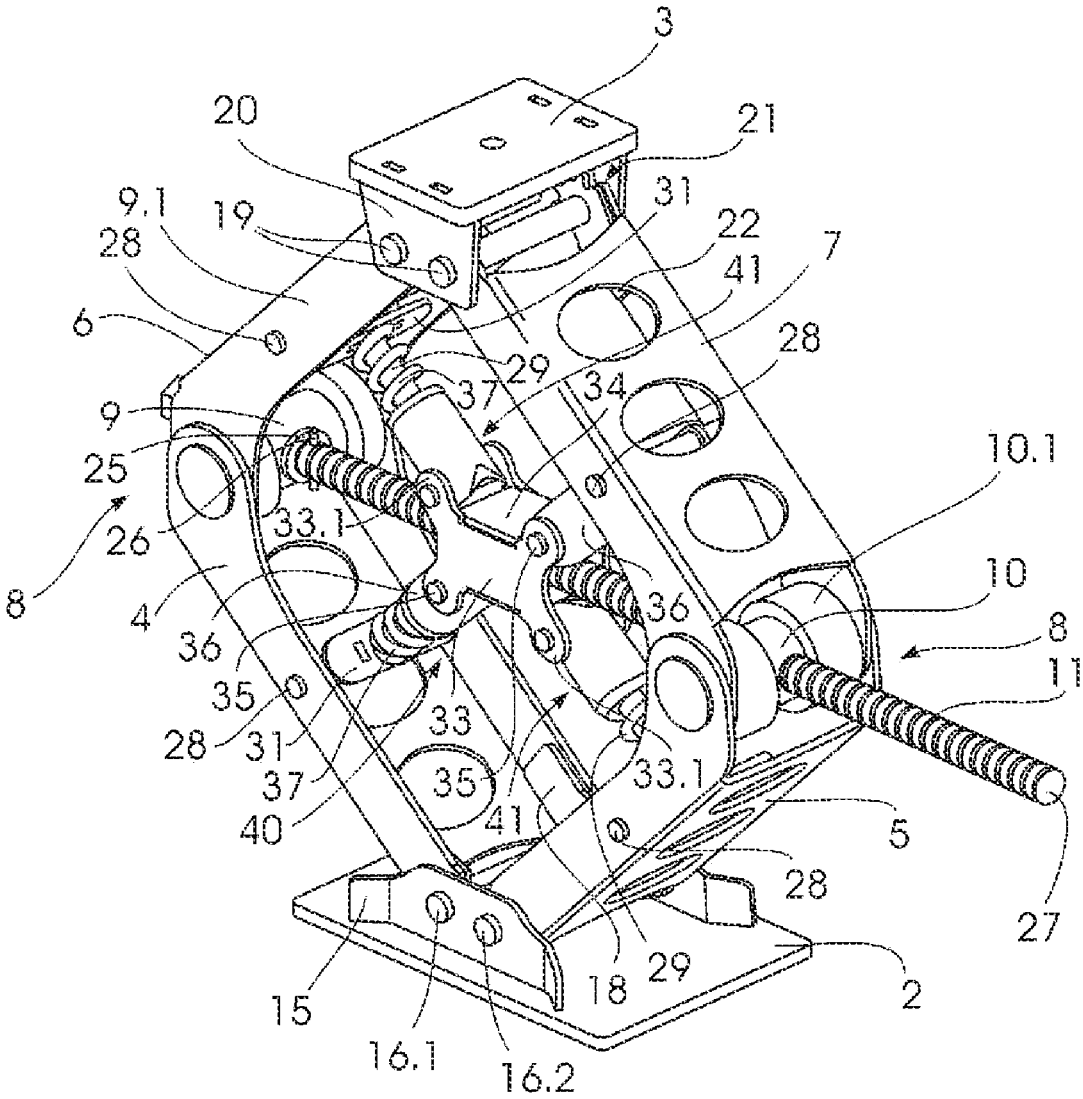
FIG. 2 shows a second perspective view.
Figure 3:
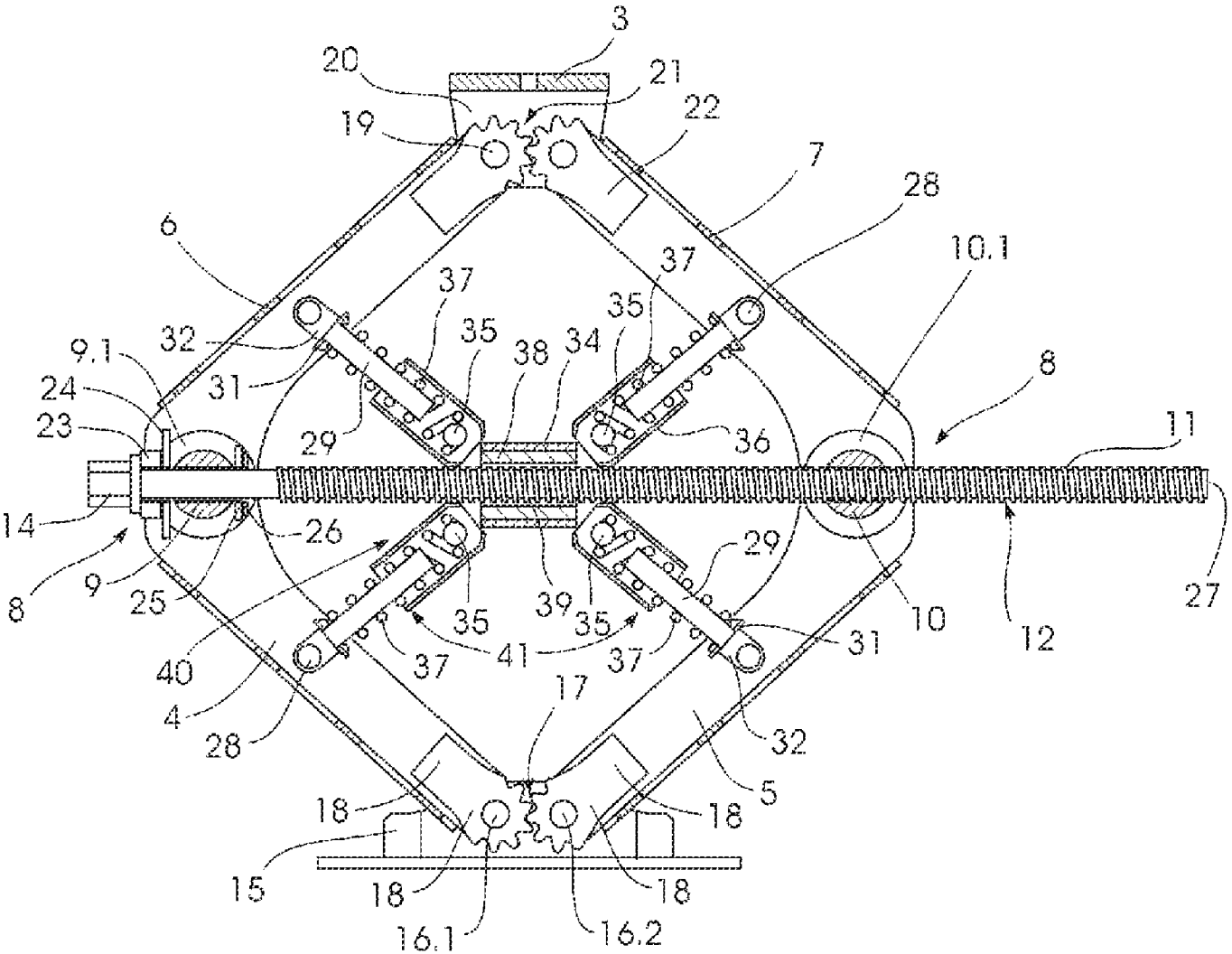
FIG. 3 shows a front cross-sectional view of the jack.

Referring to the drawings, a scissor jack in accordance with this invention is indicated generally by reference numeral (1). The jack (1) has a base (2) and a load support (3). An arrangement of four movable arms (4), (5), (6) and (7) between these components provides for the usual arrangement common to jacks of this kind.

The arms (4), (5), (6) and (7) are channeled to receive the numerous pins and two trunnions which hold the assembled jack components together.

The arms (4), (5), (6) and (7) form two elbow joints (8), each with a trunnion (9) and (10) whereby arms (4) and (6) and arms (5) and (7) are respectively hingedly connected. The one trunnion (10) has an internally screw-threaded bore. The threads match screw-threads (11) on a shaft (12) connecting the threaded trunnion (10) to the other one, which is a slave trunnion (9) with a smooth bore. The shaft (12) is journaled in the slave trunnion (9). A flange (13) on the shaft (12) prevents it from passing through the trunnion (9).

A working end (14) of the shaft (12) provided adjacent the flange (13) is configured to receive a turning tool or handle (not shown). The working end (14) is shown with flats providing a hexagonal head. The head (14) will be received by a correspondingly shaped socket on, what is usually, a cranked turning handle. Alternatively, the head may have an eye therethrough to receive a hook.

The base (2) has a pair of spaced apart lugs (15). The lower arms (4) and (5) are pivotably mounted on base pins (16) extending between the lugs (15). The hinged, lower ends of the arms (4) and (5) adjacent the base (2) are profiled with co-operating, meshing teeth (17). These ends and teeth (17) are reinforced by plates (18) of corresponding profile which fit inside the channel flanges. The upper arms (6) and (7) are similarly connected by pins (19) to lugs (20) on the load support (3). The same arrangement of teeth (21) and reinforcing plates (22) is also provided for the upper arms (6) and (7) where they are hinged to the support (3).

The flange (13) is provided at the inner side of the head (14) on the shaft (12). A thrust bearing (23) and washer (24) are fitted against the flange (13). The washer (24) locates against outer side of the slave trunnion (9). On the opposite, inner side of the slave trunnion (9) is another washer (25) on the shaft (12). A split pin (26) through the shaft (12) holds this washer (25) in place and secures the shaft (12) in position, against longitudinal movement with respect to the slave trunnion (9). The shaft (12) is free to be rotated using a suitable turning handle, as already mentioned. The portion of the shaft (12) from its free end (27) to adjacent the slave trunnion (9) is threaded.

The features of the jack (1) thus far described are generally known. In accordance with this invention, the jack (1) includes a movable brace (40) supported between the arms (4), (5), (6) and (7).

Each of the arms (4), (5), (6) and (7) has a pair of aligned openings to receive a guide pin (28) across its channel flanges. Mounted on these pins (28) are rods (29) extending inwardly to a guide assembly (30). The rods (29) extend from base plates (31) having formations (32) with holes to receive the pins (28). The guide (30) has two substantially rectangular side plates (33), each with four spaced apart openings in rounded lugs (33.1) at the corner regions. Four pins (35) extend between the plates (33). The pins (35) secure the plates (33) in spaced apart relationship relative to each other with an upper and lower cover plate (34) secured between them.

Extending outwardly from each of the pins (35) is a socket (36). Aligned openings through the socket walls receive the pins (35) to pivotably secure the four sockets (36) between the plates (33). The rods (29) are received in the sockets (36) as shown. Four coil springs (37) are provided on the rods (29) and in the sockets (36) respectively. These rod (29) and socket (36) arrangements, together with the springs (37), provide extensible connectors (41) for the movable brace (40).

Housed between the plates (33) and (34) is an elongate guide block (38). The block (38) has a smooth longitudinal bore (39) which receives the threaded shaft (12) as shown. The block (38) is preferably an oil based nylon or other similar self lubricating material. Grub screws (not shown) through the cover plates (34) will hold the block in place. The block (38) serves to locate the guide assembly (30) in relation to the shaft (12) during operation of the jack (1). The arrangement of the brace (40) with its connectors (41) is self-centralizing.

The trunnions (9) and (10) are each fitted with a pair of nylon spacers (9.1) and (10.1). The spacers are located against the channel flanges at the elbow joints (8).

In use, the shaft (12) is rotated and the trunnions (9) and (10) drawn towards each other as the threaded trunnion (10) moves along the shaft (12). The support (3) is moved away from the base (2), usually to lift a vehicle (not shown) from the ground.

The brace (40) reinforces the jack (1) as the arms (4), (5), (6) and (7) pivot and the elbows (8) straighten in the lifting operation. As this happens, the space between the elbows (8) and the guide assembly (30) is reduced. The arrangement of the trunnions (9) and (10), guide pins (28) on the arms and guide assembly (30) is selected to compress the connector springs (37) as the jack (1) is moved into its extended condition. The compression of the springs (37) adds to the rigidity of the structure. As the elbows (8) move towards the guide assembly (30), the outward force exerted by the compressed springs (37) will assist in the extension of the jack (1) to lift a load.

An acute angle is formed between the connector (41) on each side of the guide assembly (30) respectively. This angle is increased as the jack (1) extends bringing the springs (37) towards a vertical, in-line condition. The mechanical assistance of force exerted by the springs (37) is therefore pronounced towards the latter part of the extension, which is ideally when the body of a vehicle has been engaged and is being lifted.

The base pin (16.1) to the side of the working end (14) of the shaft (12) will preferably be positioned slightly higher in the lug (15) than the other pin (16.2). This results in upward movement of the support (3) in a slight arc away from the working end (14) of the shaft (12) on extension of the jack (1). The support will thus follow a vehicle body as it is tipped away onto wheels at the opposite side of the vehicle. Jacks which lift straight up must tilt on their base, which can result in slipping out from under a vehicle. This is particularly so under off-road conditions where the ground is not solid or even. The arcuate movement of the support (3) can also be provided by having one of the arms slightly longer than the others.

The selection of suitable springs (37), the arrangement for their compression, and other variations to the movable brace (40) and its connectors (41) will be within the design competence of a suitably skilled person. It will be appreciated that the coil springs can be replaced by alternative springs, which may also be hydraulic or pneumatic. Lighter springs may be selected more for support than to assist in lifting.

In an alternative embodiment, the brace is provided by hinged plates of a fixed length. Four connector plates extend inwardly each from one of the arms. The plates are connected to a fifth, central plate. This arrangement of five plates is duplicated between the channel flanges on both sides of the jack. The two central plates may be connected and guided by a block which is slidably engaged to the shaft. The position of pins on the arms and on the central plate is selected so that the distance between the pins for each connector plate remains constant during extension and retraction of the jack. Such a brace will not assist extension in the same manner as the first described embodiment but provides the benefit of reinforcing the assembly.

The brace may also be provided by a pair of elongate plates extending between the one lower arm to the opposite upper arm on one side of the jack and from the other lower arm to the other upper arm on the opposite side. Again, with proper positioning of pivot pins on the channel flanges, reinforcement of the jack is provided.

It will be understood that other arrangements may also be employed whereby springs are compressed by a movable brace. For example, the pivotable connectors may be of a fixed length and secured to a central guide assembly which is split into two parts, each of which slidably engages the shaft. A spring can then be located on the shaft between the two parts. The arrangement will be such that the spring is compressed during the lifting operation of the jack.

A person skilled in the art will appreciate that a number of other variations may be made to the features of the jack described without departing from the scope of the current invention. As one example, the brace may be positioned spaced apart to the front and/or rear of the jack and need not extend inwardly directly from channel flanges.

The invention claimed is:

1. A scissor jack comprising four arms hingedly arranged to provide two opposite elbows between a base and a load support, with a pair of trunnions one at each elbow and connected by a threaded shaft, and a movable brace slideably engaging the shaft between the arms with connectors pivotally supported between the brace and each arm.

2. A jack as claimed in claim 1 in which the connectors are extensible.

3. A jack as claimed in claim 2 in which each connector includes a spring which is compressed on extension of the jack.

4. A jack as claimed in claim 3 in which each connector is a socket and rod arrangement with a coil spring located over the rod in the socket.

* * * * *